United States Patent [19]

Bermingham

[11] 4,057,117

[45] Nov. 8, 1977

[54] AUGER SPOIL DISPOSAL BOX

[75] Inventor: Christopher William Bermingham, Dundas, Canada

[73] Assignee: Bermingham Construction Limited, Hamilton, Canada

[21] Appl. No.: 708,948

[22] Filed: July 27, 1976

[30] Foreign Application Priority Data

Aug. 29, 1975 Canada ..... 234632

[51] Int. Cl.[2] ..... E02D 17/144

[52] U.S. Cl. ..... 175/88; 37/82; 175/161; 294/69 R

[58] Field of Search ..... 175/84, 88, 161; 294/69 R; 214/82; 37/81, 82

[56] References Cited

U.S. PATENT DOCUMENTS

| | | | |
|---|---|---|---|
| 684,762 | 10/1901 | Taylor | 37/82 |
| 1,554,309 | 9/1925 | Tippett | 294/69 R |
| 2,085,029 | 6/1937 | Lambert | 294/69 R |
| 3,495,667 | 2/1970 | Cales | 175/84 |
| 3,894,400 | 7/1975 | Stillwell et al. | 175/88 |

*Primary Examiner*—Ernest R. Purser
*Assistant Examiner*—William F. Pate, III
*Attorney, Agent, or Firm*—Wenderoth, Lind & Ponack

[57] ABSTRACT

An auger drilling apparatus includes a spoil disposal box guided on the lower end of the auger leads. The auger extends vertically through the box and deposits spoil from the hole being drilled into the box. During drilling, the box rests on the ground at the top of the hole being drilled. When the box is filled, it can be raised on the leads to an elevated position and eject the spoil directly into a dump truck.

12 Claims, 5 Drawing Figures

FIG. 3
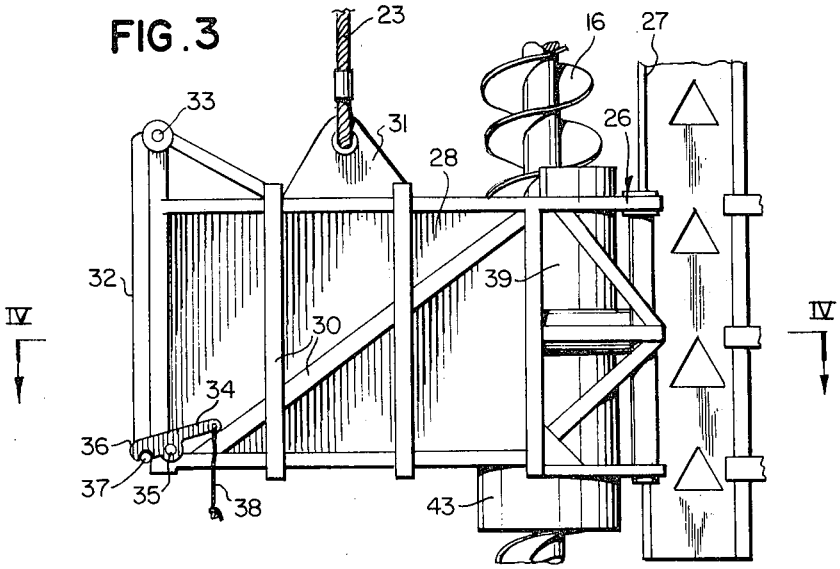
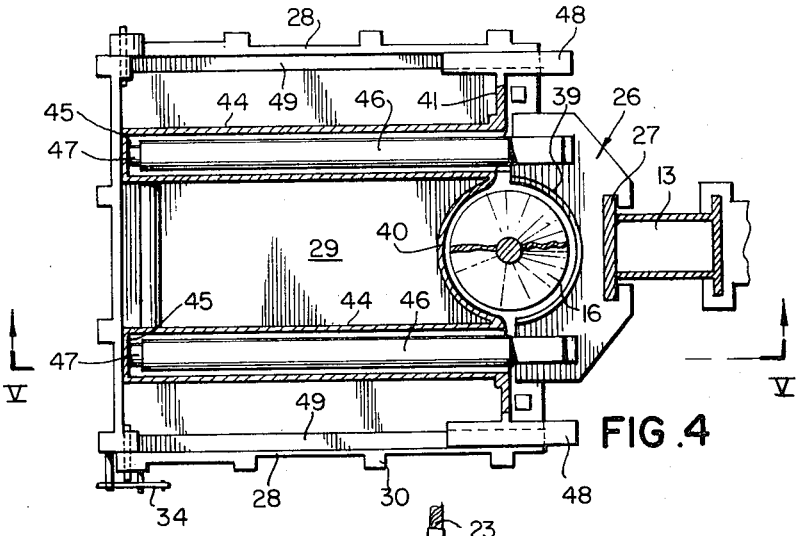
FIG. 4
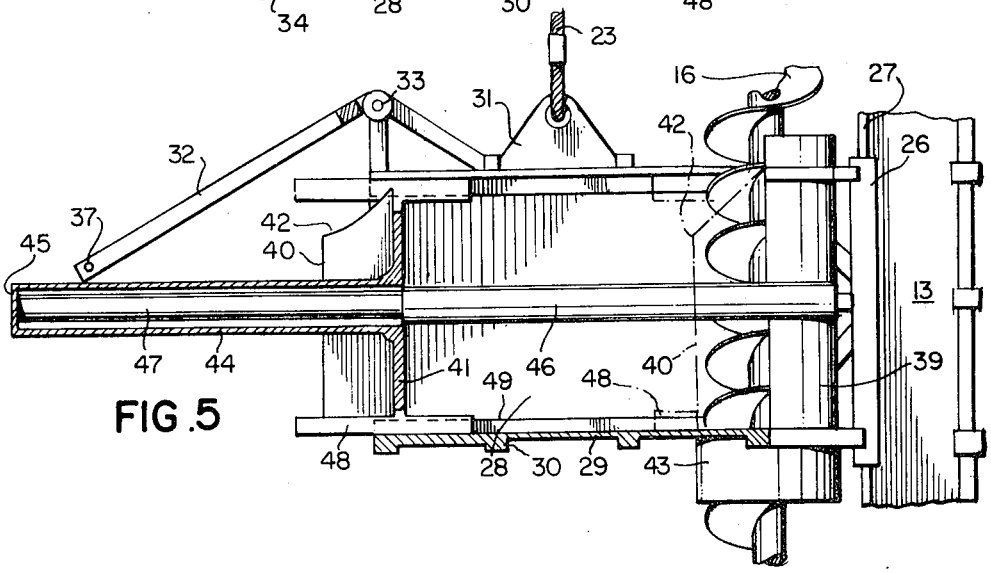
FIG. 5

AUGER SPOIL DISPOSAL BOX

FIELD OF THE INVENTION

The invention relates to improvements in auger drilling apparatus and, in particular, to a new or improved structure for removing the spoil produced during auger drilling operations.

DESCRIPTION OF THE PRIOR ART

Conventionally, the spoil produced during auger drilling operations is dumped on the ground surrounding the hole being drilled as the auger is removed from the hole, this spoil subsequently being collected either manually or by use of mechanized equipment such as a bucket loader, and loaded in a dump truck for disposal. Proposals have been made to provide buckets or the like to receive spoil from the flights of an auger as the latter is withdrawn from a hole, but in such known arrangements it is necessary to provide belt conveyors or the like to deliver the spoil from the bucket, e.g. into a dump truck.

SUMMARY OF THE INVENTION

According to the present invention, there is provided a drilling apparatus comprising: an auger for drilling a hole in the ground; leads extending parallel to and supporting said auger and means for guiding said auger to move longitudinally of said leads during drilling; drive means for rotating said auger and for moving said auger longitudinally of said leads; and a container for receiving spoil produced by said auger during drilling, said container being guided upon a lower end of said lead, said auger extending through said container; means for moving said container longitudinally of said leads between a loading position, wherein the container is situated on the ground at the top of a hole being drilled by the auger to receive spoil removed from the hole by the auger, and a dumping position wherein the container is raised above the ground, and means for discharging spoil from the container when the latter is in the dumping position. By providing for the container to be movable vertically on the leads, it is possible, when the container is filled with the spoil, to raise to a height sufficient to permit ejection of the spoil directly into a dump truck without the use of any intermediate conveyor means.

In a preferred embodiment, the container is a box-like structure, the means for discharging spoil comprising a wall in the container movable transversely thereof by means of hydraulic cylinders to displace the spoil through an opening on the other side of the container. The opening may be provided by a pivoted gate which can be latched in the closed position during drilling.

BRIEF DESCRIPTION OF THE DRAWINGS

The invention will further be described, by way of example only, with reference to the accompanying drawings wherein:

FIG. 3 is an enlarged view of a detail of the auger drilling apparatus;

FIG. 4 is a sectional view taken on the line IV-IV in FIG. 3; and

FIG. 5 is a sectional view taken on the line V-V but showing the parts in a different position.

DESCRIPTION OF THE PREFERRED EMBODIMENT

Figure 1:
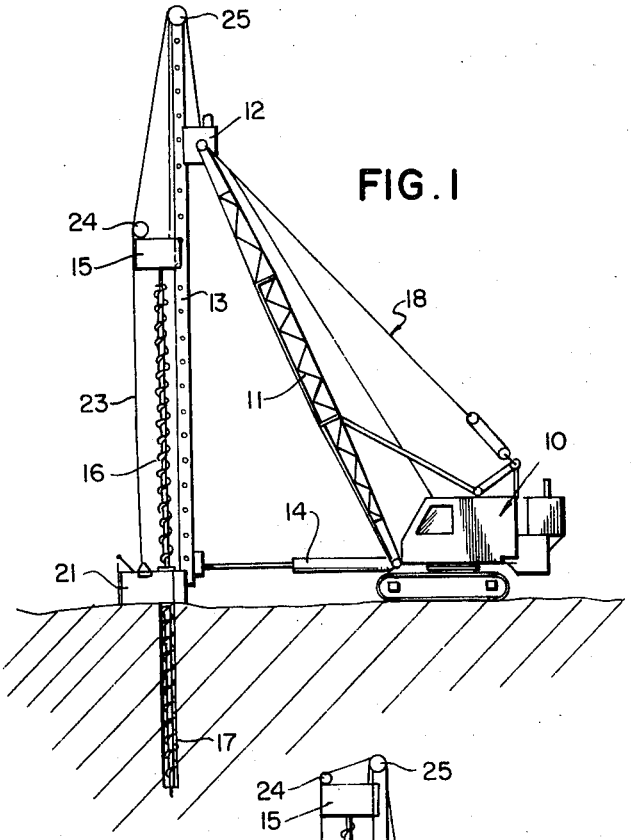
FIG. 1 is an elevation of an auger drilling apparatus during drilling operation.
Figure 2:
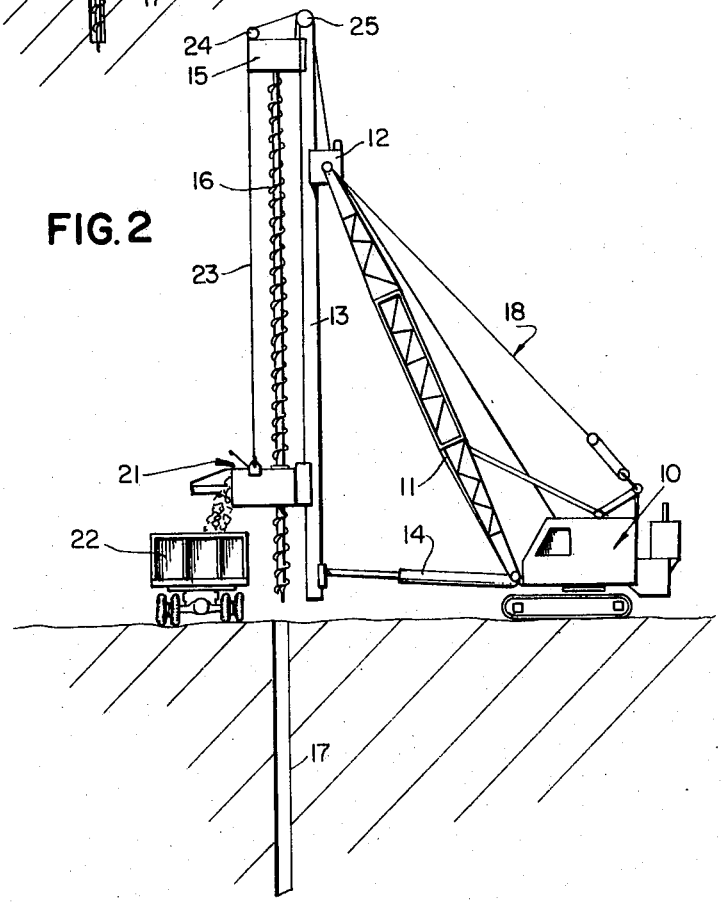
FIG. 2 is a view similar to FIG. 1 showing the apparatus in a spoil dumping position.

As shown in FIGS. 1 and 2, the auger drilling apparatus comprises a tracked vehicle 10 having an upwardly extending boom 11 on which is mounted a bracket 12. Auger leads 13 are supported near the upper end in the bracket 12 being movable vertically therein, the lower end of the leads being guided and positioned by adjustable strut means 14 extending from the lower end of the boom.

A housing 15 is guided for vertical movement on the lead 13 and includes a motor (not shown) for applying a reversible rotating drive to an auger 16 which is movable vertically with the housing and rotatable by the motor to drill a hole 17 in the ground. Thus far, the construction of the drilling apparatus is conventional, the positioning and movements of the leads 13, housing 15 and auger 16 being controlled in known manner from the operator's cab of the vehicle 10 by cable systems generally illustrated at 18 and/or by electrical and/or hydraulic systems (not shown).

A spoil disposal structure is provided in the form of a boxlike container 21 extending laterally from the lower end of the lead 13 and guided for vertical movement thereon between a loading position (FIG. 1) wherein the container rests on the ground at the top of the hole 17, and a dumping position (FIG. 2) wherein the container is raised on the leads 13 to an elevated position for dumping of the spoil into a truck 22. The container 21 is moved between the loading position and the dumping position by means of a cable system 23 guided over pulley means 24 on the housing 15 and a further pulley means 25 at the top of the leads 13 and powered by a motor (not shown) within the vehicle 10.

The construction and function of the container 21 appears more clearly from FIGS. 3 to 5 to which reference will now be made. The container 21 is of box-like form and comprises a mounting structure 26 guided for vertical movement on a flange 27 of the leads 13 and extending laterally therefrom. The container comprises two vertical side walls 28 and a horizontal base 29 formed integrally with the mounting structure 26. These walls are suitably of steel sheets reinforced with suitable stiffening braces 30. Each of the side walls 28 includes an upwardly extending lug 31 which forms an attachment point for the cable system 23.

The outer end of the container 21 provides an opening selectively closed by closure means in the form of a displaceable end wall 32 pivotally mounted at its upper end on a horizontal axis 33 so that it may be opened in the manner of a truck tailgate. At the lower outer corner of each vertical wall 28 is a latching element 34 pivotally mounted on a shaft 35. The latching element is preferably resiliently biased in the counterclockwise direction as seen in FIG. 3, and has a jaw 36 engagable over a pin 37 in the lower edge of the end wall 32 in order to secure the latter in a closed position. The latching elements 34 may be coupled to move in unison, and a dependent chain 38 may be attached thereto to facilitate movement of the latching element to the released position.

The auger 16 is movable vertically through the container 21 in a tubular guide which is defined on one side by a semi-cylindrical wall 39 integral with and extending the full height of the mounting structure 26. The opposite side of the tubular guide is defined by a semi-cylindrical section 40 of a vertical wall 41 extending transversely between the two vertical walls 28 of the container. The vertical wall 41 has an area substantially corresponding to the transverse cross section of the container except that the top of the cylindrical section 40 is angled downwardly away from the auger 16, as shown at 42 in FIG. 5. Extending below the base wall 29 of the container is a short cylindrical sleeve 43 integral with the container and mounting structure 26 and forming a downward extension of the tubular guide.

As shown in FIGS. 4 and 5, two tubular casings 44 extend longitudinally of the container 21, one on each side of the auger 16, each having a closed distal end 45 adjacent the end wall 32 of the container. Each tubular casing receives an hydraulic piston and cylinder assembly, the cylinder 46 of which is connected to the mounting structure 26, and the piston rod 47 of which is connected to the closed end 45 of the tubular casing. Hydraulic fluid can be supplied to the cylinders 46 selectively to extend or retract the piston rod 47 and move the wall 41 from a retracted position to an advanced position. The retracted position of the wall 41 is shown in FIG. 4, and in broken lines at the right hand side of FIG. 5. In this position, the wall 41 lies adjacent the mounting structure 26 with the semi-cylindrical section 40 lying closely adjacent the auger 16. When hydraulic fluid is supplied to the cylinders 46, the wall 41 is moved, to the left as seen in FIG. 5, to the advanced position shown in full lines. During this movement, the vertical orientation of the wall 41 is maintained through the operation of four L-shaped guides 48 carried by the corners of the wall which co-operate with slides 49 extending along the upper and lower edges of each of the vertical walls 28 of the container. The wall 41, casings 44 and the piston cylinder assembles constitute discharging means for discharging spoil from the container as will be described hereinbelow.

It will be evident that with the latching elements 34 released from the pins 37, movement of the wall 41 from the retracted position will cause the end wall 32 of the container to be pivoted away from the first position through interaction with the closed ends 45 of the tubular casings 44, so that in the fully advanced position of the vertical wall 41, the end wall 32 will occupy the position as shown in the left hand side of FIG. 5.

In operation, when a hole 17 is being drilled, the container 21 is lowered onto the ground by means of the cable system 23 and the auger 16 is rotated and moved downwardly to bore the hole. Periodically, the auger is withdrawn from the hole, and spoil removed from the hole on the auger flights is deposited within the container since the upper edge 42 of the semi-cylindrical section 40 of the wall 41 is at a lower level than the upper edge of the semi-cylindrical wall 39 in the mounting structure 26, the wall 41 being, of course, in the retracted position, and the end wall 32 being closed and latched during drilling operations.

When the container 21 becomes filled with spoil, it is raised to the elevated position shown in FIG. 2 by means of the cable system 23, a dump truck 22 is positioned underneath, the latching elements 34 are disengaged from the pin 37, and hydraulic fluid is supplied to the cylinders 46 to move the wall 41 to the advanced position. It will be evident that during this movement, the end wall 32 is opened, and spoil within the container is pushed in front of the advancing wall 41 and expelled from the container to fall into the dump truck 22. Thereafter, the wall 41 is removed to the retracted position, the end wall 32 closed and latched, and the container 21 lowered once more to the ground to receive spoil produced by further drilling operation of the auger.

In the foregoing, the invention is described in relation to a drilling apparatus in which the leads 13 are movable vertically. It will be understood that the invention may equally well be employed in apparatus where the leads do not have this vertical travel capability.

Furthermore, although in the illustrated embodiment the spoil disposal box is shown as mounted at one end upon the leads and projecting laterally therefrom, the invention may also be employed in a drilling apparatus having "box type" leads, i.e. where the leads are of U-shaped or open channel construction. In this latter arrangement, the container can be accommodated substantially entirely within the channel opening of the leads.

Similarly various arrangements of discharging means are possible as an alternative to the pivoted end wall 32 of the described embodiment. For example, the end wall 32 could be replaced by a pair of doors pivoted about the vertical sides of the container, or a hinged door could be provided in the base of the container.

In some instances, it may be feasible to dispense with the latching means 34,35 and instead utilize springs or counterweights to bias the end wall 32 to the closed position.

I claim:

1. A drilling apparatus comprising: an auger for drilling a hole in the ground; leads extending parallel to and supporting said auger and means for guiding said auger to move longitudinally of said leads during drilling; drive means for rotating said auger and for moving said auger longitudinally of said leads; and a container for receiving spoil produced by said auger during drilling, said container being guided upon a lower end of said leads, said auger extending through said container and said container being movable on said leads independently of said auger; means for moving said container longitudinally of said leads independently of said auger between a ground-engaging loading position, wherein the container is situated on the ground at the top of a hole being drilled by the auger to receive spoil removed from the hole by the auger, and an elevated dumping position wherein the container is raised above the ground, and means for discharging spoil from the container when the latter is in the dumping position.

2. A drilling apparatus according to claim 1 wherein said container comprises a box-like structure having a closed bottom, and said container means has closure comprising a wall section of said container movably mounted thereon and movable between a closed position, and an open position wherein it defines an opening for discharge of spoil from the container.

3. A drilling apparatus comprising: an auger for drilling a hole in the ground; leads extending parallel to and supporting said auger, and means for guiding said auger to move longitudinally of said leads during drilling; drive means for rotating said auger and for moving said auger longitudinally of said leads; a container for receiving spoil produced by said auger during drilling, said container being guided on a lower end of said leads, and being a box-like structure having a closed bottom and a closure means constituted by a wall section movably mounted on said box-like structure and movable between a closed position and an open position wherein it defines an opening for discharge of spoil from the container, said auger extending through said container; and discharging means in said container comprising a displacable wall movable from a retracted position opposite said wall section to an advanced position adjacent said wall section to displace spoil from said container through said opening.

4. A drilling apparatus according to claim 3 wherein said container is integral with a mounting structure guided on said leads, actuator means for moving said displaceable wall between the advanced and retracted positions comprising hydraulic piston and cylinder assemblies connected to act between said displaceable wall and said mounting structure.

5. A drilling apparatus according to claim 3 wherein said auger extends through the container in a tubular guide formed on one side by said mounting structure and on the other side by said displaceable wall.

6. A drilling apparatus according to claim 3 wherein said auger extends through the container in a tubular guide formed on one side by said mounting structure and on the other side by said displaceable wall, the side of the tubular guide formed by the mounting structure having an upper edge positioned above the upper edge of the other side.

7. A drilling apparatus according to claim 4 wherein said hydraulic piston and cylinder assemblies are received in tubular casings in said displaceable wall having closed ends extending towards said wall section, such that in operation said closed ends engage and move said wall section to the open position as the displaceable wall is moved towards the advanced position.

8. A drilling apparatus comprising: an auger for drilling a hole in the ground; leads extending parallel to and supporting said auger, and means for guiding said auger to move longitudinally of said leads during drilling; drive means for rotating said auger and for moving said auger longitudinally of said leads; a container for receiving spoil produced by said auger during drilling, said container being carried upon said leads to receive spoil removed from said hole by the auger, said auger extending through said container and said container comprising a box-like structure having a closed bottom, closure means comprising a wall section of said container movably mounted thereon and movable between a closed position, and an open position wherein it defines an opening for discharge of spoil from the container, and discharging means comprising a displaceable wall movable from a retracted position opposite to said wall section to an advanced position adjacent said wall section to displace spoil from said container through said opening.

9. A drilling apparatus according to claim 8 wherein said container is integral with a mounting structure guided on said leads, actuator means for moving said displaceable wall between the advanced and retracted positions comprising hydraulic piston and cylinder assemblies connected to act between said displaceable wall and said mounting structure.

10. A drilling apparatus according to claim 8 wherein said auger extends through the container in a tubular guide formed on one side by said mounting structure and on the other side by said displaceable wall.

11. A drilling apparatus according to claim 8 wherein said auger extends through the container in a tubular guide formed on one side by said mounting structure and on the other side by said displaceable wall, the side of the tubular guide formed by the mounting structure having an upper edge positioned above the upper edge of the other side.

12. A drilling apparatus according to claim 9 wherein said hydraulic piston and cylinder assemblies are received in tubular casings in said displaceable wall having closed ends extending towards waid wall section, such that in operation said closed ends engage and move said wall section to the open position as the displaceable wall is moved towards the advanced position.

* * * * *